US006613145B2

(12) United States Patent
Asahi

(10) Patent No.: US 6,613,145 B2
(45) Date of Patent: Sep. 2, 2003

(54) COATING BOOTH FOR FILM

(75) Inventor: Tomio Asahi, Saitama (JP)

(73) Assignee: Japan Alumibody Maintenance Co., Ltd., Saitama (JP)

( * ) Notice: Subject to any disclaimer, the term of this patent is extended or adjusted under 35 U.S.C. 154(b) by 62 days.

(21) Appl. No.: 10/001,795

(22) Filed: Dec. 5, 2001

(65) Prior Publication Data

US 2002/0088395 A1 Jul. 11, 2002

(30) Foreign Application Priority Data

Jan. 5, 2001 (JP) ..... 2001-000758

(51) Int. Cl.[7] ..... B05B 15/12

(52) U.S. Cl. ..... 118/309; 118/58; 118/326; 118/500; 454/52; 454/50; 55/DIG. 46

(58) Field of Search ..... 454/50, 53, 57, 454/52, 66; 55/DIG. 46; 118/309, 326, 50, 58, 500, DIG. 7

(56) References Cited

U.S. PATENT DOCUMENTS 4,133,255 A * 1/1979 Guice ..... 98/115
4,647,033 A * 3/1987 Emrich ..... 271/276
6,328,797 B1 * 12/2001 Parzych et al. ..... 118/66
6,419,744 B1 * 7/2002 Southworth ..... 118/68

FOREIGN PATENT DOCUMENTS

TW 228856 8/1994

* cited by examiner

*Primary Examiner*—Richard Crispino
*Assistant Examiner*—Yewebdar T Tadesse
(74) *Attorney, Agent, or Firm*—Young & Thompson

(57) ABSTRACT

A coating booth for film having a table on which a film to be coated is mounted, an air intake which is provided in the ceiling of the booth and through which open air is cleaned and introduced into the inside of the booth, and an exhaust system which sucks up the introduced air from the side walls of the table to make a substantially horizontal air flow inside the table and discharges the air outside, wherein the table has a substantially horizontal tabletop with a plurality of suction holes so that a film mounted thereon are held by suction by the action of the air flow inside the table.

8 Claims, 4 Drawing Sheets

COATING BOOTH FOR FILM

FIELD OF THE INVENTION

The present invention relates to a coating booth for film and more particularly a booth for forming an overcoating layer on a marking film.

BACKGROUND OF THE INVENTION

In recent years, various marking films are stuck to the bodies of vehicles such as automobiles and passenger cars for the purpose of advertising, etc.

Marking films comprise a base film made of polyvinyl chloride, etc. on which letters or images are printed on a high-speed printer, and the printed base film is laminated with a transparent cover film.

Because the cover film is adhered to the base film via a transparent adhesive, it sometimes separates from the base film due to deterioration of the adhesive with time. Where a cover film made of a fluorine resin having excellent weatherability is used seeking a high quality finish, the production cost greatly rises, and the marking film becomes thick, which is inconvenient for sticking to a car body, etc.

As an approach to solve these problems, it has been attempted to form an overcoating film on the printed base film placed on a horizontal table with an inexpensive transparent coating by ink jet printing or screen printing. These methods are not practical, however, because a high-quality finish cannot be secured due to appearance of scanning lines on the overcoating layer or a failure to achieve a sufficient coating thickness.

Therefore, where an overcoating layer is formed of a transparent coating, the printed base film is disposed vertically, and the coating is sprayed thereon by a skilled worker with a spray gun. Such a coating method has very poor productivity and incurs high cost.

Under these circumstances, a coating booth for film has been demanded, in which an overcoating layer can be provided on a printed base film with each at good productivity to provide a marking film having a high-quality finish and satisfactory weatherability.

SUMMARY OF THE INVENTION

An object of the present invention is to provide a convenient coating booth for making a weatherable high-quality marking film at low cost.

As a result of extensive studies, the present inventor has found that the above object is accomplished by a coating booth for film having a table on which a film to be coated is mounted, an air intake which is provided in the ceiling of the booth and through which open air is cleaned and introduced into the inside of the booth, and an exhaust system which sucks up the introduced air from the side walls of the table to make a substantially horizontal air flow inside the table and discharges the air outside, wherein the table has a substantially horizontal tabletop with a plurality of suction holes so that a film mounted thereon are held by suction by the action of the air flow inside the table.

BRIEF DESCRIPTION OF THE DRAWINGS

The present invention will be more particularly described with reference to the accompanying drawings, in which.

DETAILED DESCRIPTION OF THE PREFERRED EMBODIMENTS

Figure 1:
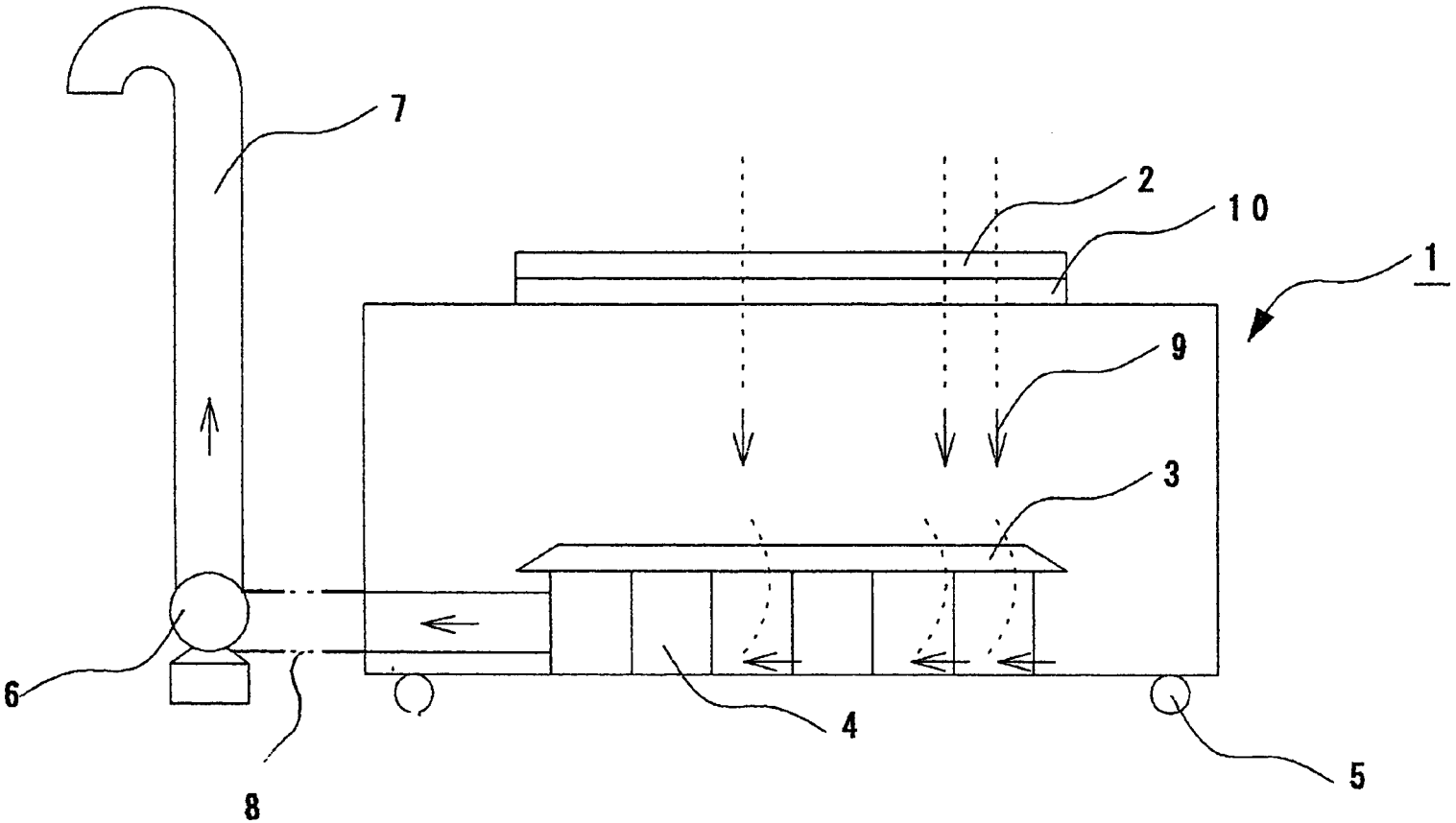
FIG. 1 illustrates an example of the coating booth according to the present invention.

The present invention will be described with reference to the accompanying drawings. FIG. 1 illustrates an example of the coating booth according to the present invention. Numeral 1 indicates a coating booth; 2, an air intake (a micro filter); 3, a table; 4, a filter; 5, a roller; 6, an exhaust fan; 7, a duct; 8, a flexible duct; 9, an air flow; and 10, an air flow distributor.

Figure 2:
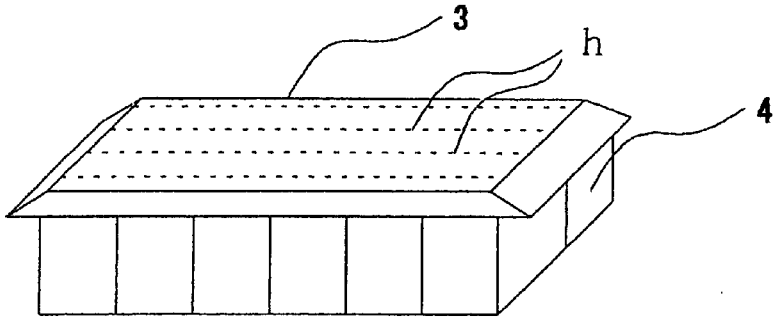
FIG. 2 is a perspective of a table used in the coating booth of FIG. 1.

A film to be coated, e.g., a printed base film, is mounted on the substantially horizontal tabletop of the table 2. The table 2 is made of stainless steel, etc. As shown in FIG. 2, the tabletop of the table 3 has a plurality of suction holes h. The side walls of the table 3 are made of a filter 4 for air passage. The film can be securely held on the table 3 by the suction force of air through the suction holes 7 without an aid of an adhesive tape, etc.

Figure 3:
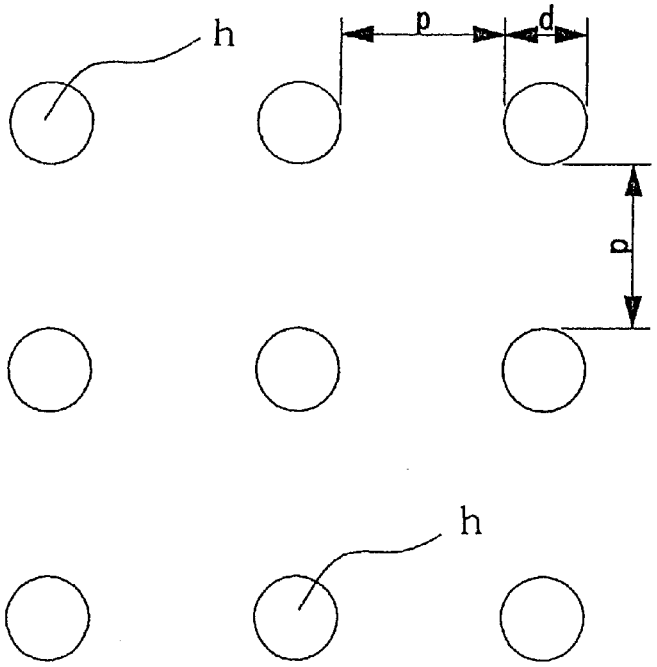
FIG. 3 is a partial plan of a table used in the coating booth according to the present invention.

From the standpoint of suction performance, it is preferred for the suction holes h to have a diameter (d) of 3 to 10 mm each and a pitch (p) of 10 to 20 mm (see FIG. 3). An example of the table has a 1 m wide and 3 m long tabletop with 77 rows (in the width direction) of 231 (in the length direction) holes each, the holes each having a diameter of 3 mm and being aligned at a pitch of 10 mm. In cases where the film is smaller than the size of the tabletop, the unnecessary suction holes h can be covered with adhesive tape, etc.

Figure 4:
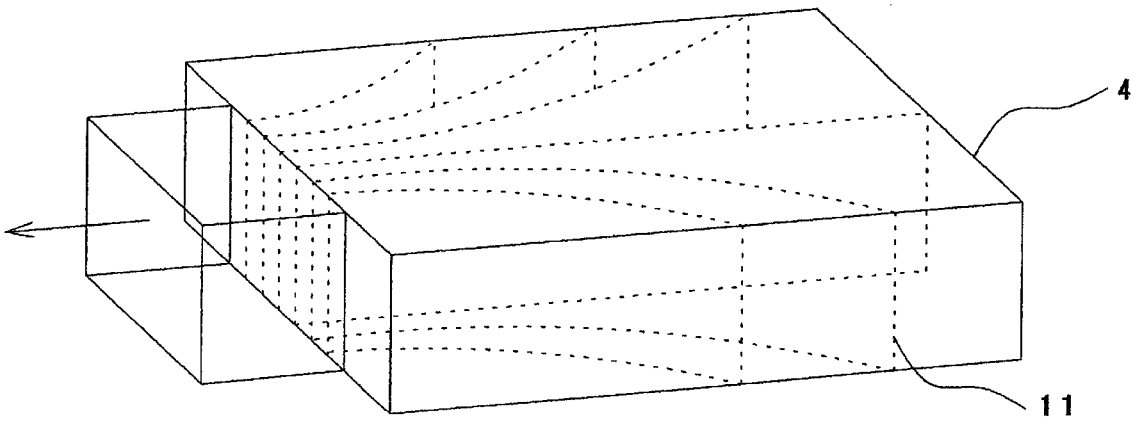
FIG. 4 is a perspective of a filter used in the coating booth according to the present invention.

The side walls below the tabletop of the table 3 are constructed of a filter 4, preferably a glass filter. Inside the table 3 are provided partitions 11 to guide air flow 9 as shown in FIG. 4.

The coating booth 1 has an air intake 2 in the ceiling, through which open air is cleaned and introduced into the inside of the booth. The air intake 2 has a micro filter by which dust in open air is collected to clean air to be introduced.

Figure 5:
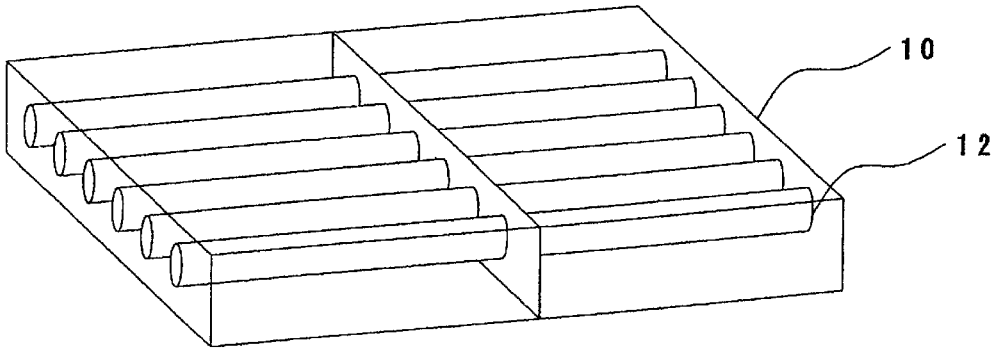
FIG. 5 is a perspective of an air flow distributor which is provided in the air intake of the coating booth according to the present invention.

The air intake 2 (micro filer) can be provided with an air flow distributor 10 or an air fan (not shown). As shown in FIG. 5, the distributor 10 has partitions 12 so as to supply clean air into the booth in a regulated flow.

Figure 6:
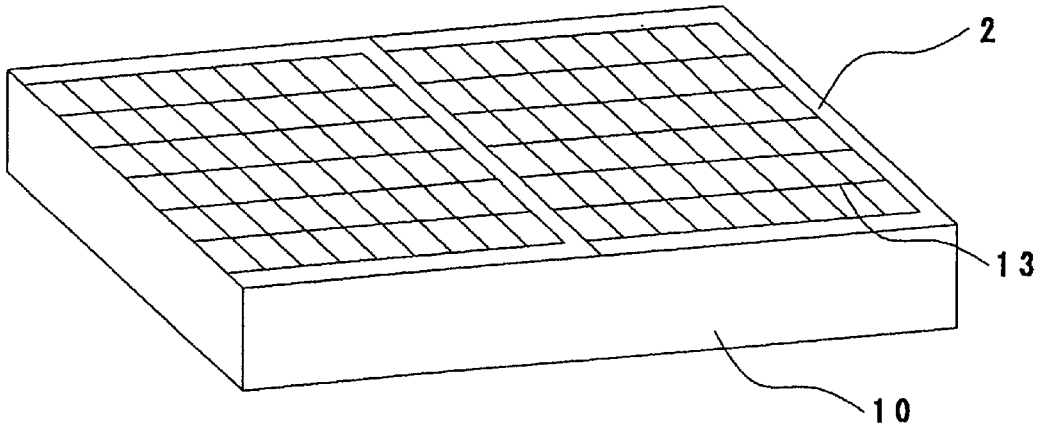
FIG. 6 is a perspective of the air intake of the coating booth according to the present invention, which has an air flow distributor attached thereto.
Figure 7:
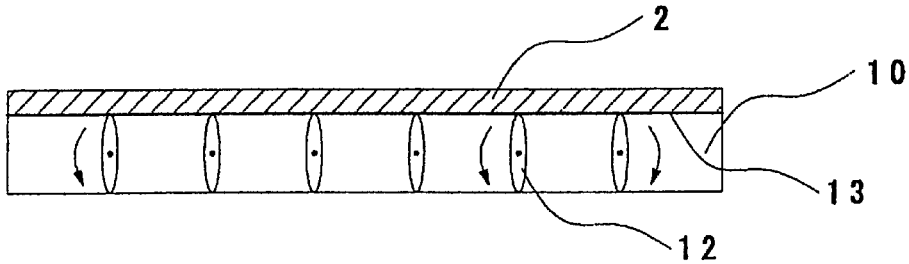
FIG. 7 is a cross-section of the air intake of the coating booth according to the present invention, which has an air flow distributor attached thereto.

FIGS. 6 and 7 show a perspective and a cross-section, respectively, of the air intake having an air flow distributor attached thereto. An air flow distributor 10 having partitions 12 is attached to the micro filter 2 (air intake) via a metal net 13.

In FIG. 1, an exhaust fan 6, a duct 7, and a flexible duct 8 constitute an exhaust system for discharging air. The main part of the booth is detachable from the duct portion at the flexible duct 8. The main part of the booth has rollers 5 so as to be movable on the floor.

In carrying out coating, a printed base film is put on the tabletop of the table 3. On switching on the exhaust fan 6, air as purified through the air intake 2 is introduced through the distributor 10 into the inside of the booth 1. The air flow rate is preferably 0.2 to 0.8 m/sec. The air flow 9 enters into the inside of the table 3 through the side walls beneath the tabletop, i.e., the filter 4 and is made to flow substantially horizontally inside the table 3 and discharged through the flexible duct 8 and the duct 7.

In this air flow 9, the base film is held onto the substantially horizontal tabletop of the table 3 by suction force. In this situation, a coating is applied to the base film either manually or automatically to form an overcoating layer. The coating is applied in single or double ply according to the intended use, each ply having a thickness of about 20 to 35 $\mu$m.

The present invention will now be illustrated in greater detail with reference to Example. The following Example is presented as being exemplary of the present invention and should not be considered as limiting.

EXAMPLE

A coating booth having a length of 4.0 m and a height of 2.2 m shown in FIG. 1 was used. The side walls of the booth were made of foamed polyurethane. The booth had a 1 m wide and 3 m long table, the tabletop of which had 77 (in the width direction) times 231 (in the length direction) suction holes each having a diameter (d) of 3 mm at a pitch (p) of 10 mm.

A printed base film was placed on the tabletop, and the exhaust fan was switched on to make an air flow at a rate of 0.2 to 0.8 m/sec at room temperature. The film was manually coated by means of a spray gun to form a single-ply overcoating layer having a thickness of about 20 to 35 $\mu$m.

During the coating operation, the base film was securely held on the table. The resulting overcoating layer was free from dust or coating scum and exhibited excellent adhesion to the base film and satisfactory weatherability. As compared with overcoating film formation by the conventional lamination technique, the cost was 1/10 or less.

By use of the coating booth according to the present invention, a high-quality coated film with satisfactory weatherability can be produced with ease, economy, and productivity. The coating booth of the present invention is especially effective in forming an overcoating layer of a marking film.

What is claimed is:

1. A coating booth for film having a table on which a film to be coated is mounted, an air intake which is provided in the ceiling of the booth and through which open air is cleaned and introduced into the inside of the booth, and an exhaust system which sucks up the introduced air from the side walls of said table to make a substantially horizontal air flow inside said table and discharges the air outside, wherein said table has a substantially horizontal tabletop with a plurality of suction holes so that a film mounted thereon are held by suction by the action of the air flow inside said table.

2. The coating booth for film according to claim 1, wherein said air intake has a micro filter.

3. The coating booth for film according to claim 1, wherein said air intake has an air flow distributor or an air fan or both.

4. The coating booth for film according to claim 1, wherein said suction holes each have a diameter of 3 to 10 mm and arranged at a pitch of 10 to 20 mm.

5. The coating booth for film according to claim 1, wherein said table has a filter on the side walls thereof beneath said tabletop.

6. The coating booth for film according to claim 5, wherein said table has an air flow distributor inside.

7. The coating booth for film according to claim 1, wherein said exhaust system has an exhaust fan, a duct, and a flexible duct, the main part of the booth is detachable from the duct portion at said flexible duct, and said flexible duct allows the main part of the booth to move.

8. The coating booth for film according to claim 1, wherein said film to be coated is a base film having a letter or an image printed thereon.

* * * * *